US008307669B2

(12) United States Patent
Taras et al.

(10) Patent No.: US 8,307,669 B2
(45) Date of Patent: Nov. 13, 2012

(54) MULTI-CHANNEL FLAT TUBE EVAPORATOR WITH IMPROVED CONDENSATE DRAINAGE

(75) Inventors: Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 463 days.

(21) Appl. No.: 12/527,779

(22) PCT Filed: Feb. 27, 2007

(86) PCT No.: PCT/US2007/004993

§ 371 (c)(1),
(2), (4) Date: Aug. 19, 2009

(87) PCT Pub. No.: WO2008/105760

PCT Pub. Date: Sep. 4, 2008

(65) Prior Publication Data

US 2010/0012307 A1 Jan. 21, 2010

(51) Int. Cl.
*F25D 21/14* (2006.01)

(52) U.S. Cl. ..... 62/290; 165/177; 62/288

(58) Field of Classification Search ..... 165/176, 165/177; 62/288

See application file for complete search history.

(56) References Cited

U.S. PATENT DOCUMENTS

| | | | | |
|---|---|---|---|---|
| 3,902,551 | A * | 9/1975 | Lim et al. | 165/111 |
| 5,279,360 | A | 1/1994 | Hughes et al. | |
| 5,505,254 | A * | 4/1996 | Chiba | 165/148 |
| 5,826,649 | A | 10/1998 | Chapp et al. | |
| RE37,040 | E * | 2/2001 | Hughes et al. | 62/288 |
| 6,749,015 | B2 * | 6/2004 | Moreau | 165/174 |
| 2004/0035559 | A1 * | 2/2004 | Ko et al. | 165/110 |
| 2007/0204978 | A1 * | 9/2007 | Beamer | 165/124 |
| 2007/0251681 | A1 * | 11/2007 | Higashiyama et al. | 165/153 |

FOREIGN PATENT DOCUMENTS

| | | | |
|---|---|---|---|
| JP | 07190661 | A | 7/1995 |
| JP | 07190661 | A * | 7/1995 |
| JP | 2000028228 | A | 1/2000 |
| JP | 2006242458 | A | 9/2006 |

OTHER PUBLICATIONS

International Search Report mailed Nov. 3, 2008 (3 pgs.).
International Preliminary Report on Patentability mailed Sep. 11, 2009 (5 pgs.).
Office Action in Chinese Patent Application No. 200780052683.3, Issued, Oct. 8, 2010, 18 pages.

* cited by examiner

*Primary Examiner* — Allen Flanigan
(74) *Attorney, Agent, or Firm* — Cantor Colburn LLP

(57) ABSTRACT

A heat exchange tube includes a tubular member having a flattened cross-section and extending along a longitudinal axis, and a longitudinally extending condensate drain channel formed in an upper wall of the flattened tubular member. A heat exchanger includes a first and a second spaced apart and generally vertical longitudinally extending headers, a plurality of heat exchange tubes disposed in parallel, spaced relationship in a generally vertical array and extending longitudinally between the first header and the second header, and a condensate drain extending longitudinally along, the upper wall of at least one of the plurality of flattened heat exchange tubes. The condensate drain may comprise a longitudinally extending condensate drain channel formed in an upper wall of said flattened tubular member, and/or a series of condensate drain portals formed in the heat transfer fins in a base portion bounding to the upper external surface of at least one heat exchange tube. The condensate drain portals of neighboring heat transfer fins are aligned longitudinally to provide a series of longitudinally aligned condensate drain portals along the upper external surfaces of the heat exchange tubes.

28 Claims, 4 Drawing Sheets

MULTI-CHANNEL FLAT TUBE EVAPORATOR WITH IMPROVED CONDENSATE DRAINAGE

FIELD OF THE INVENTION

This invention relates generally to refrigerant vapor compression system heat exchangers having a plurality of parallel, flat heat exchange tubes extending between a first header and a second header with heat transfer fins positioned between these tubes, and more particularly, to providing for improved drainage of condensate collecting on the external surfaces of these flat tubes and fins.

BACKGROUND OF THE INVENTION

Refrigerant vapor compression systems are well known in the art. Air conditioners and heat pumps employing refrigerant vapor compression cycles are commonly used for cooling or cooling/heating air supplied to a climate controlled comfort zone within a residence, office building, hospital, school, restaurant or other facility. Refrigerant vapor compression systems are also commonly used for cooling air, or other secondary media such as water or glycol solution, to provide a refrigerated environment for food items and beverage products within display cases, bottle coolers or other similar equipment in supermarkets, convenience stores, groceries, cafeterias, restaurants and other food service establishments.

Conventionally, these refrigerant vapor compression systems include a compressor, a condenser, an expansion device, and an evaporator serially connected in refrigerant flow communication. The aforementioned basic refrigerant vapor compression system components are interconnected by refrigerant lines in a closed refrigerant circuit and arranged in accord with the vapor compression cycle employed. The expansion device, commonly an expansion valve or a fixed-bore metering device, such as an orifice or a capillary tube, is disposed in the refrigerant line at a location in the refrigerant circuit upstream, with respect to refrigerant flow, of the evaporator and downstream of the condenser. The expansion device operates to expand the liquid refrigerant passing through the refrigerant line, connecting the condenser to the evaporator, to a lower pressure and temperature. The refrigerant vapor compression system may be charged with any of a variety of refrigerants, including, for example, R-12, R-22, R-134a, R-404A, R-410A, R-407C, R717, R744 or other compressible fluid.

In some refrigerant vapor compression systems, the evaporator is a parallel tube heat exchanger having a plurality of flat, typically rectangular or oval in cross-section, multi-channel tubes extending longitudinally in parallel, spaced relationship between a first generally vertically extending header or manifold and a second generally vertically extending header or manifold, one of which serves as an inlet header/manifold. The inlet header receives the refrigerant flow from the refrigerant circuit and distributes this refrigerant flow amongst the plurality of parallel flow paths through the heat exchanger. The other header serves to collect the refrigerant flow as it leaves the respective flow paths and to direct the collected flow back to the refrigerant line to return to the compressor in a single pass heat exchanger, which in this case, serves as an outlet header/manifold, or to a downstream bank of parallel heat exchange tubes in a multi-pass heat exchanger. In the latter case, this header is an intermediate manifold or a manifold chamber and serves as an inlet header to the next downstream bank of parallel heat transfer tubes.

Each multi-channel tube generally has a plurality of flow channels extending longitudinally in parallel relationship the entire length of the tube, each channel providing a relatively small flow area refrigerant flow path. Thus, a heat exchanger with multi-channel tubes extending in parallel relationship between the inlet and outlet headers of the heat exchanger will have a relatively large number of small flow area refrigerant flow paths extending between the two headers. Sometimes, such multi-channel heat exchanger constructions are called microchannel of minichannel heat exchangers as well. Commonly, for evaporator applications, the heat exchanger generally includes heat transfer fins positioned between heat transfer tubes for heat transfer enhancement, structural rigidity and heat exchanger design compactness. The heat transfer tubes and fins are permanently attached to each other (as well as to the manifolds) during a furnace braze operation. The fins may have flat, wavy, corrugated or louvered design and typically form triangular, rectangular, offset or trapezoidal airflow passages.

When a heat exchanger is used as an evaporator in a refrigerant vapor compression system, moisture in the air flowing through the evaporator and over the external surfaces of the refrigerant conveying tubes and associated fins of the heat exchanger condenses out of the air and collects on the external surface of the those tubes and fins. In general, condensate naturally drains well from refrigerant vapor compression system evaporators having round heat transfer tubes and plate fins due to the cylindrical outer surface of a round tube and vertically extended plate fins. For evaporator heat exchangers having the flat tubes and serpentine fins arranged in a vertical orientation extending between a pair of horizontally disposed headers, such as, for example, the heat pump evaporator/condenser heat exchanger disclosed in U.S. Pat. No. 5,826,649, the condensate depositing on the heat transfer tubes and associated heat transfer fins inherently drains down the vertically extending tubes under the influence of gravity. The draining condensate is typically collected in a drain pan disposed beneath the heat exchanger.

U.S. Pat. No. 5,279,360 discloses an evaporator heat exchanger having an array of parallel heat exchange tubes of flattened cross-section disposed in spaced relationship with V-shaped fins disposed between the facing flat surfaces of adjacent heat exchange tubes. Each heat exchange tube is bent into a V-shape and disposed in a vertical plane with its inlet end connected in fluid communication with a first horizontally extending header and its outlet end connected in fluid communication with a second horizontally extending header. The apexes of the arrayed V-shape-bent heat exchange tubes are aligned at a lower elevation than the headers, and a condensate trough is disposed therebeneath. Condensate collecting on the flattened heat exchange tubes and the fins therebetween drains downwardly along the respective fin-free edge surfaces of the flattened heat exchange tubes to the condensate trough.

However, with respect to prior art heat exchangers having tubes of flattened cross-section disposed horizontally and extending longitudinally in a horizontal direction between a pair of spaced, generally vertical headers, condensate collecting on the upper side of the tubes does not drain therefrom because of the horizontal disposition of the flat external surface of the lube. If the condensate collecting on the external surfaces of the heat exchanger tubes becomes excessive, overall performance of the refrigerant vapor compression system will be adversely impacted. For example, excessive condensate retention on the external surfaces of the heat exchange tubes can result in increased air side pressure drop through the evaporator which causes increased fan power consumption and reduced heat transfer through the heat transfer tubes. Also, condensate collecting on the external surfaces of the heat transfer tubes of the evaporator may be undesirability re-entrained in the air passing through the evaporator and transversely over the flattened tubes. Further, under certain conditions, excessive condensate retention promotes faster frost accumulation and undesirably requires more frequent defrost cycles.

SUMMARY OF THE INVENTION

In an aspect of the invention, a heat exchange tube includes a tubular member having a flattened cross-section and extending along a longitudinal axis, and a longitudinally extending condensate drain channel formed in an upper wall of said flattened tubular member. The tubular member has an upper wall and a lower wall defining at least one longitudinally extending fluid flow passage therebetween, a leading edge and a trailing edge. The condensate drain channel may extend along a longitudinal axis positioned centrally between the leading edge and the trailing edge of the flattened tubular member, or along a longitudinal axis positioned closer to the leading edge than the trailing edge of the flattened tubular member, or along a longitudinal axis positioned closer to the trailing edge than the leading edge of the flattened tubular member. The condensate drain channel formed in the upper external surface of the upper wall of the flattened tubular member may extend downwardly the full height of the fluid flow passage or less than the height of the fluid flow passage.

In an aspect of the invention, a heat exchanger for cooling a flow of air passing therethrough includes a first and a second spaced apart and generally vertical longitudinally extending headers; a plurality of heat exchange tubes disposed in parallel, spaced relationship in a generally vertical array and extending longitudinally between the first header and the second header, each of the heat exchange tubes having a longitudinal axis, a flattened cross-section, an upper wall and a lower wall defining at least one longitudinally extending fluid flow passage in fluid communication between the headers; and a condensate drain extending longitudinally along the upper wall of at least one of the plurality of flattened heat exchange tubes. In an embodiment, the condensate drain comprises a longitudinally extending condensate drain channel formed in the upper wall of at least one of the plurality of flattened heat exchange tubes. The condensate drain channel may extend along a longitudinal axis positioned centrally between the leading edge and the trailing edge of the flattened tubular member, or along a longitudinal axis positioned closer to the leading edge than the trailing edge of the flattened tubular member, or along a longitudinal axis positioned closer to the trailing edge than the leading edge of the flattened tubular member. The condensate drain channel formed in the upper external surface of the upper wall of the flattened tubular member may extend downwardly the full height of the fluid flow passage or less than the height of the fluid flow passage.

The heat exchanger may include a plurality of heat transfer fins extending between adjacent heat exchange tubes of the parallel tube array. In an embodiment, the condensate drain comprises at least one condensate drain portal formed in each fin of the plurality of fins in a base portion bounding the upper external surface of at least one heat exchange tube. The condensate drain portals of neighboring fins are aligned longitudinally, thereby providing a series of longitudinally aligned condensate drain portals along the upper external surface of the heat exchange tube. The condensate drain portals may be aligned to extend along a longitudinal axis positioned centrally between the leading edge and the trailing edge of the flattened tubular member, or along a longitudinal axis positioned closer to the leading edge than the trailing edge of the flattened tubular member, or along a longitudinal axis positioned closer to the trailing edge than the leading edge of the flattened tubular member. In an embodiment of the heat exchanger, a series of longitudinally aligned condensate drain portals pass through the fins superadjacent a longitudinally extending condensate drain channel formed in the upper wall of the heat exchange tube against which the base of the fins abuts.

In an aspect of the invention, the heat exchange tubes may be disposed at a slight angle of declination with the horizontal to allow gravity to enhance the drainage of condensate along the longitudinally extending condensate drains. An angle of declination of at least 5 degrees, and generally in the range of at least 5 degrees to about 10 degrees, will generally be sufficient to enhance drainage of condensate along the condensate drains, whether channels or portals. In an embodiment, the heat transfer tubes may be formed in the shape of an inverted-V. In an embodiment, the heat transfer tubes may be formed in the shape of an arch.

In an embodiment of the heat exchanger, each flattened heat exchange tube defines a plurality of parallel fluid flow paths extending parallel to a longitudinal axis thereof, with each fluid flow path of the plurality of parallel fluid flow paths having an inlet to the fluid flow path opening in fluid communication to the first header and an outlet to the fluid flow path opening in fluid communication to the second header. The plurality of the channels defining the flow paths within each heat transfer tube may be, for instance, of circular, oval, rectangular, triangular or trapezoidal cross-section. In an embodiment, each of the fluid flow paths may comprise a refrigerant flow path.

BRIEF DESCRIPTION OF THE DRAWINGS

In the following detailed description of the invention, reference will be made to and is to be read in connection with the accompanying drawing, where.

DETAILED DESCRIPTION OF THE INVENTION

Figure 1:
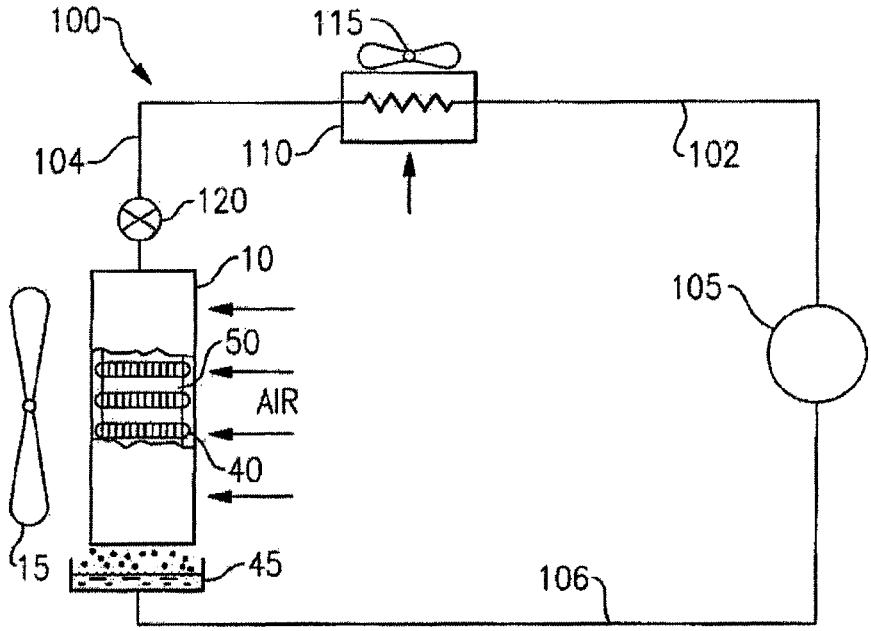
FIG. 1 is a schematic diagram of a refrigerant vapor compression system incorporating a flat tube heat exchanger as an evaporator.

The heat exchanger of the invention will be described herein in use as an evaporator in connection with a simplified air conditioning cycle refrigerant vapor compression system 100 as depicted schematically in FIG. 1. Although the exemplary refrigerant vapor compression cycle illustrated in FIG. 1 is a simplified air conditioning cycle, it is to be understood that the heat exchanger of the invention may be employed in refrigerant vapor compression systems of various designs, including, without limitation, heat pump cycles, economized cycles, cycles with tandem components such as compressors and heat exchangers, chiller cycles, cycles with reheat, subcritical cycles, supercritical cycles, and many other cycles including various options and features.

The system 110 will be described herein within a subcritical application. The refrigerant vapor compression system 100 includes a compressor 105, a condenser 110, an expansion device 120, and the heat exchanger 10, functioning as an evaporator, connected in a closed loop refrigerant circuit by refrigerant lines 102, 104 and 106. In supercritical applications, the heat exchanger 110 would function as a gas cooler, rather than a condenser. The compressor 105 circulates hot, high pressure refrigerant vapor through discharge refrigerant line 102 into the inlet header of the condenser 110, and thence through the heat exchanger tubes of the condenser 110 wherein the hot refrigerant vapor is desuperheated, condensed to a liquid and typically subcooled as it passes in heat exchange relationship, with a cooling fluid, such as ambient air, which is passed over the heat exchange tubes of the condenser by the condenser fan 115.

The high pressure refrigerant leaves the condenser (the gas cooler, in supercritical applications) 110 and thence passes through the refrigerant line 104 to the evaporator heat exchanger 10, traversing the expansion device 120 wherein the refrigerant is expanded to a lower pressure and temperature to form a refrigerant liquid/vapor mixture. The now lower pressure and lower temperature, expanded refrigerant thence passes through the heat exchange tubes 40 of the evaporator heat exchanger 10 wherein the refrigerant is evaporated and typically superheated as it passes in heat exchange relationship with air to be cooled (and, in many cases, dehumidified), which is passed over the heat exchange tubes 40 and associated heat transfer fins 50 by the evaporator fan 15. The refrigerant leaves the evaporator heat exchanger 10 predominantly in a vapor thermodynamic state and passes therefrom through the suction refrigerant line 106 to return to the compressor 105 through the suction port. As the air flow traversing the evaporator heat exchanger 10 passes over the heat exchange tubes 40 and heat transfer fins 50 in heat exchange relationship with the refrigerant flowing through the heat exchange tubes 40, the air is cooled and the moisture in the air flowing through the evaporator heat exchanger 10 and over the external surface of the refrigerant conveying tubes 40 and heat transfer fins 50 of the evaporator heat exchanger 10 condenses out of the air and collects of the external surfaces of the heat exchange tubes 40 and heat transfer fins 50. A drain pan 45 is provided beneath the evaporator heat exchanger 10 for collecting condensate that drains from the external surface of the heat exchange tubes 40 and associated heat transfer fins 50.

Figure 2:
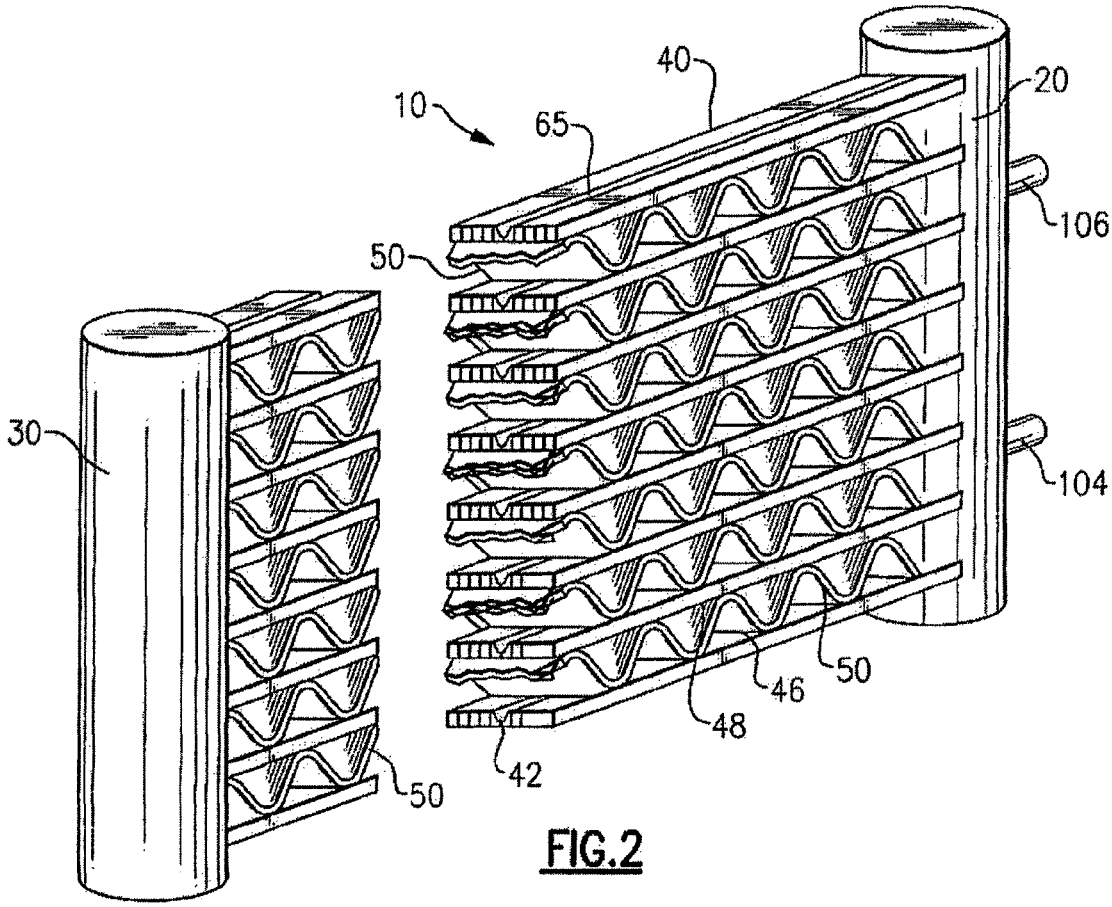
FIG. 2 is a perspective view of an exemplary embodiment of a flat tube evaporator heat exchanger in accordance with the invention.

The parallel flow heat exchanger 10 includes a plurality of heat exchange tubes 40 that are arranged in a generally vertical array. In the exemplary embodiment of the heat exchanger 10 depicted in FIG. 2, each of the heat exchange tubes 40 extends in a horizontal direction along its longitudinal axis between a generally vertically extending first header 20 and a generally vertically extending second header 30, thereby providing a plurality of parallel refrigerant flow paths between the two headers. Although the refrigerant headers 20 and 30 are shown of a cylindrical configuration, the may be of a rectangular, half of cylinder or any other shape as well as have a single chamber or multi-chamber design, depending on the refrigerant path arrangement. Each heat exchange tube 40 has a first end mounted to the first header 20, a second end mounted to the second header 30, and at least one flow channel 42 extending longitudinally, i.e. parallel to the longitudinal axis of the tube for the entire length of the tube, thereby providing a flow path in refrigerant flow communication between the first header and the second header. The internal refrigerant pass arrangement may be a multi-pass configuration, such as depicted in FIG. 2, or a single-pass configuration, depending on particular application requirements.

Referring now also to FIGS. 3A-3D, each heat exchange tube 40 comprises an elongated tubular member 44 extending along its longitudinal axis and having a generally flattened cross-section, for example, a rectangular cross-section or oval cross-section. The flattened tubular member has an upper wall 46 and a lower wall 48 and defines the at least one longitudinally extending fluid flow passage 42. The at least one fluid flow passage 42 may be subdivided into a plurality of parallel, independent fluid flow passages 42 which extend longitudinally parallel to the longitudinal axis of the tubular member 44 in a side-by-side array, thereby providing a multi-channel heat exchange tube of better performance and structural rigidity. Each flattened tubular member 44 has a leading edge 41 which faces upstream, with respect to airflow passing through the heat exchanger 10, and a trailing edge 43, which faces downstream, with respect to air flow passing through the heat exchanger 10.

Each flattened multi-channel tube 40 may have a width as measured along a transverse axis extending from the leading edge 41 to the trailing edge 43 of, for example, fifty millimeters or less, typically from ten to thirty millimeters, and a height of about two millimeters or less, as compared to conventional prior art round tubes having a diameter of ½ inch, ⅜ inch or 7 mm. The heat exchange tubes 40 are shown in the accompanying drawings, for ease and clarity of illustration, as having ten channels 42 defining flow paths having a rectangular cross-section. However, it is to be understood that in applications, each multi-channel heat exchange tube 40 may typically have from about ten to about twenty flow channels 42. Generally, each flow channel 42 will have a hydraulic diameter, defined as four times the cross-sectional flow area divided by the "wetted" perimeter, in the range generally from about 200 microns to about 3 millimeters. Although depicted as having a rectangular cross-section in the drawings, the channels 42 may have a circular, triangular, oval or trapezoidal cross-section, or any other desired non-circular cross-section. Also, heat transfer tubes 40 may have other internal heat transfer enhancement elements, such as mixers and boundary layer destructors.

As in conventional practice, to improve heat transfer between the air flowing through the heat exchanger 10 over the external surfaces of the flattened heat transfer tubes 40 and the refrigerant flowing through the parallel flow channels 42 of the heat transfer tubes 40, the heat exchanger 10 includes a plurality of external heat transfer fins 50 extending between each set of the parallel-arrayed tubes 40. The fins are brazed or otherwise securely attached to the external surfaces of the upper and lower walls of the respective tubular members 44 of adjacent tubes 40 to establish heat transfer contact, by heat conduction, between the fins 50 and the external surfaces of the flat heat transfer tubes 40. Thus, the external surfaces of the tubular members 44 of the heat transfer tubes 40 and the surfaces of the fins 50 together form the external heat transfer surface that participates in heat transfer interaction with the air flowing through the heat exchanger 10. The external heat transfer fins 50 also provide for structural rigidity of the heat exchanger 10 and quite often assist in air flow redirection to improve heat transfer characteristics. In the exemplary embodiment of the heat exchanger 10 depicted in FIG. 2, the fins 50 constitute segments of a fin strip formed as a serpentine series of generally V-shaped or generally U-shaped segments and disposed between and in heat transfer contact with the lower external surface of the lower wall 48 of one heat exchange tube 40 and the upper external surface of the upper wall 46 of the adjacent heat exchange tube 40 positioned next therebelow. Alternatively, the fins may constitute a plurality of plates disposed in parallel, spaced relationship and extending generally vertically between the heat transfer tubes 40. It is to be understood that other fin configurations, such as, for example, generally corrugated, wavy, louvered or offset fins forming triangular, rectangular, or trapezoidal airflow passages may be used in the heat exchanger 10 of the invention.

As noted hereinbefore, a heat exchanger used as an evaporator in refrigerant vapor compression system, such as, for example, but not limited to, an air conditioning system, are subject to water condensing out of the air flow passing through the evaporator and collecting on the external surfaces of the heat exchange tubes 40 of the heat exchanger 10. In the heat exchanger 10, a condensate drain 65 is provided in association with at least one of the heat exchange tubes 40 to facilitate drainage of the collected condensate therefrom. In typical evaporator applications, more than one heat exchange tube 40 of the heat exchanger 10, and frequently all of the heat exchange tubes 40 of the heat exchanger 10, have a condensate drain 65 associated therewith. With respect to each heat exchange tube 40 having an associated condensate drain 65, the condensate drain extends longitudinally along the upper external surface of the upper wall 46 of the flattened tubular member 44 of the heat exchange tube 40.

Referring now to FIGS. 3 and 4, in particular, the condensate drain 65 may comprise a longitudinally extending condensate drain channel 65A formed in the upper external surface of the upper wall 46 of the flattened tubular member 44 of the heat exchange tube 40 and/or a series of condensate drain portals 65B formed in the fins 50 in the base portion thereof abutting the upper external surface of the upper wall 46 of the flattened tubular member 44 of the heat exchange tube 40.

Figure 3A:
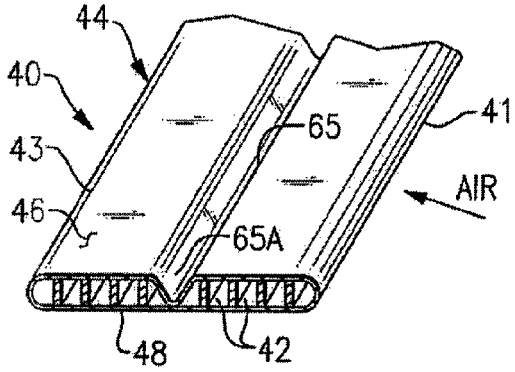
FIGS. 3A-3E are partially sectioned, elevation views of various exemplary embodiments of a flattened heat exchange tube including a condensate drain channel.
Figure 3B:
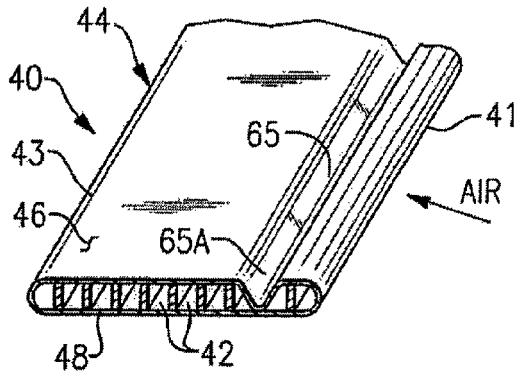
Figure 3C:
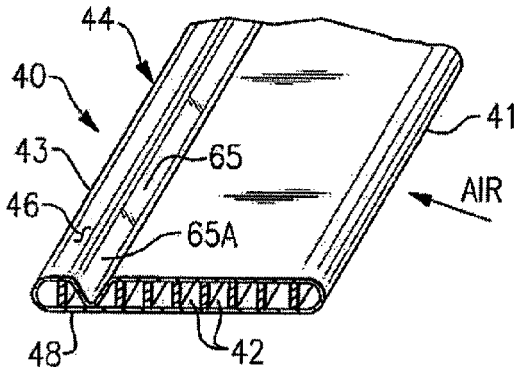
Figure 3D:
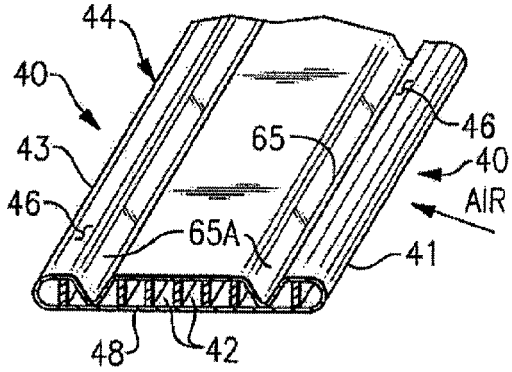

In an aspect of the invention, a longitudinally extending condensate drain channel 65A may be provided in the upper wall 46 of the flattened tubular member 44 of the heat exchange tube 40. The condensate drain channel 65A may extend along a longitudinal axis positioned centrally between the leading edge 41 and the trailing edge 43 of the flattened tubular member 44 as illustrated in FIG. 3A, or along a longitudinal axis positioned closer to the leading edge 41 than to the trailing edge 43 of the flattened tubular member 44 as illustrated in FIG. 3B, or along a longitudinal axis positioned closer to the trailing edge 43 than to the leading edge 41 of the flattened tubular member 44 as illustrated in FIG. 3C. Further, more than one condensate drain channel 65A may be provided in the upper wall 46 of the heat exchange tube 40. For example, a pair of condensate drain channels 65A may be formed in the upper wall 46 of the heat exchange tube 40 in transversely spaced relationship as illustrated in FIG. 3D.

Figure 3E:
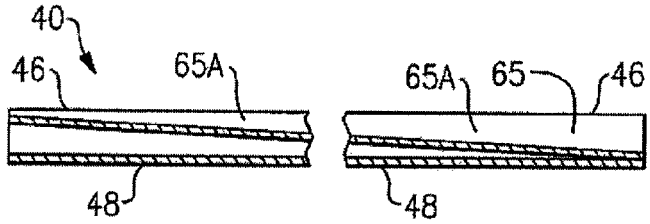

The condensate drain channels may be formed in the upper wall 46 of the heat transfer tube 40 by crimping or by extrusion during the manufacturing of the heat exchange tube 40. The depth of the condensate drain channel 65A may extend the full height of the interior of the tubular member 44 such that the inside surface of the upper wall 46 at the apex of the channel 65A touches the inside surface of the lower wall 48 of the tubular member 44. Alternately, the depth of the condensate drain channel 65A may extend only partially across the interior of the tubular member 44 such that the inside surface of the upper wall of the channel 65A does not touch the inside surface of the lower wall 48 of the tubular member 44. Also, the depth of the condensate drain channel 65A may vary along the longitudinal extent of the channel 65A, such as illustrated in FIG. 3E, so as to enhance drainage of condensate along the channel 65A towards an outer end or ends of the tubular member 44. The condensate drain channels 65A may be of any cross-section suitable for manufacturing, and in particular, of triangular, rectangular, square, trapezoidal, circular, oval or any other cross-section.

Figure 4A:
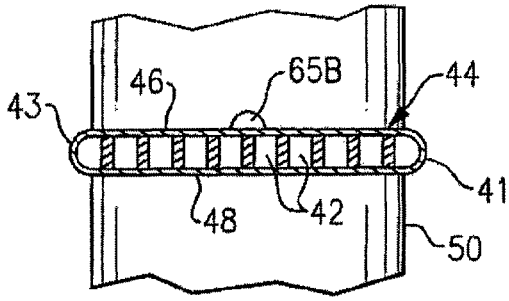
FIGS. 4A-4D are partially sectioned, elevation views of various embodiments of a flat tube heat exchanger including condensate drain portals.
Figure 4B:
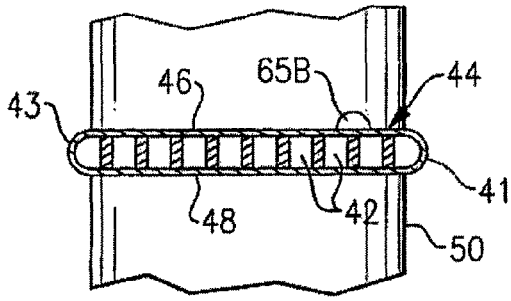
Figure 4C:
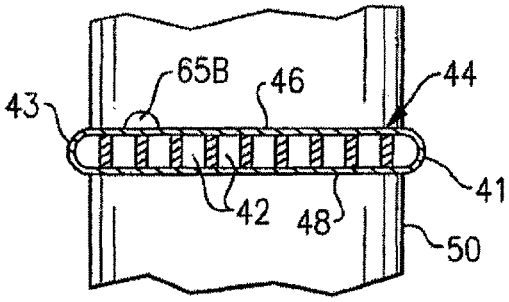
Figure 4D:
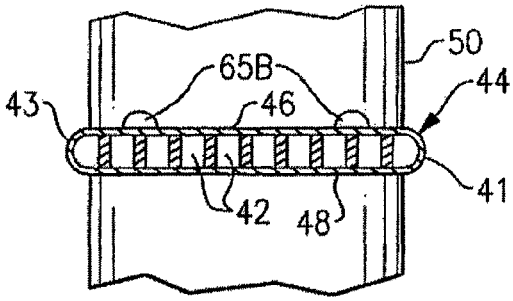

In an aspect of the invention, a series of condensate drain portals 65B are formed in the heat transfer fins 50, such as, for example, but not limited to, stamping or cutting, in the base portion thereof abutting the upper wall 46 of the flattened tubular member 44 of the heat exchange tube 40. The condensate drain portals 65B may extend along a longitudinal axis positioned centrally between the leading edge 41 and the trailing edge 43 of the flattened tubular member 44 as illustrated in FIG. 4A, or along a longitudinal axis positioned closer to the leading edge 41 than to the tailing edge 43 of the flattened tubular member 44 as illustrated in FIG. 4B, or along a longitudinal axis positioned closer to the trailing edge 43 than to the leading edge 41 of the flattened tubular member 44 as illustrated in FIG. 4C. Further, more than one condensate drain portal 65B may be provided in each of the heat transfer fins 50. For example, a first series of aligned portals 65B may be formed in the heat transfer fins 50 extending along a first longitudinal line and a second series of aligned portals 65B may be formed in the heat transfer fins 50 extending along a second longitudinal line disposed in transversely spaced relationship with the first longitudinal line of portals in the heat transfer fins 50, as illustrated in FIG. 4D.

Figure 5:
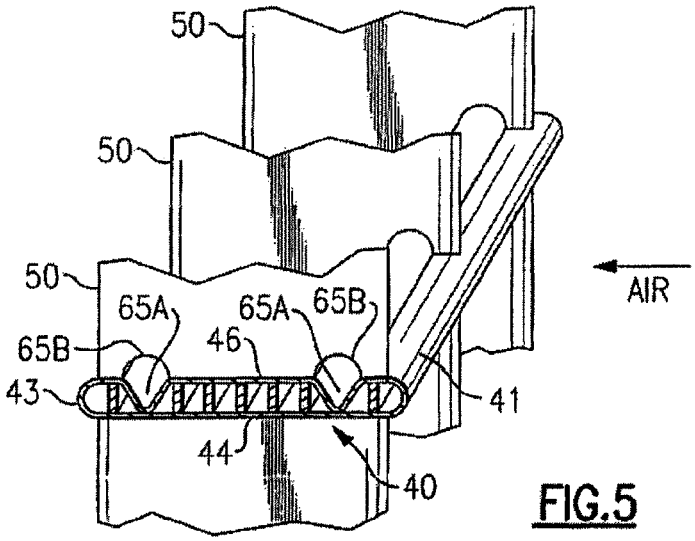
FIG. 5 is a partially sectioned, elevation view of an exemplary embodiment of a flat tube heat exchanger having both condensate drain channels and condensate drain portals.

The condensate drain portals 65B may be aligned along a longitudinally extending so as to provide a path by which condensate collecting on the upper external surfaces of the heat exchange tube 40 against which the base of the heat transfer fins 50 abut in the heat exchanger 10. In an embodiment, as illustrated FIG. 5, the condensate drain may include both a condensate drain passage 65A and a corresponding series of condensate drain portals 65B wherein a series of condensate drain portals formed in the heat transfer fins 50 are aligned along a longitudinal line co-linear with a longitudinal line along which a condensate drain channel 65A is formed in the upper wall 46 of the flattened upper member 44 against which the fins 50 abut. As the condensate drain channels 65A, the condensate drain portals 65B may be of any cross-section suitable for manufacturing, and in particular, of triangular, rectangular, square, trapezoidal, circular, oval or any other cross-section.

Figure 6:
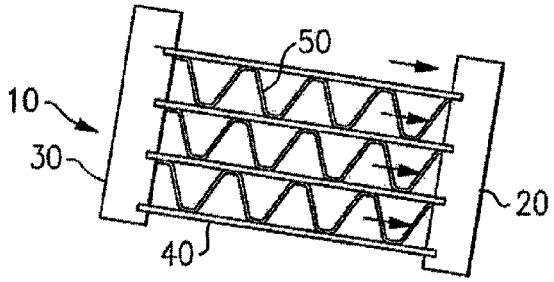
FIG. 6 is an elevation view of another exemplary embodiment of a flat tube heat exchanger having condensate drains.
Figure 7:
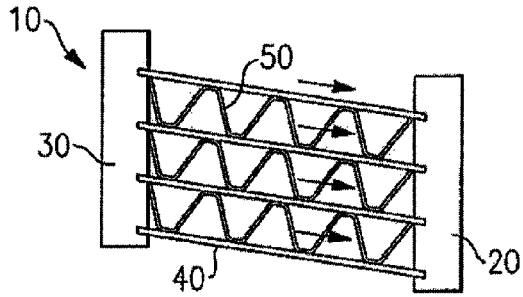
FIG. 7 is ah elevation view of another exemplary embodiment of a flat tube heat exchanger having condensate drains.
Figure 8:
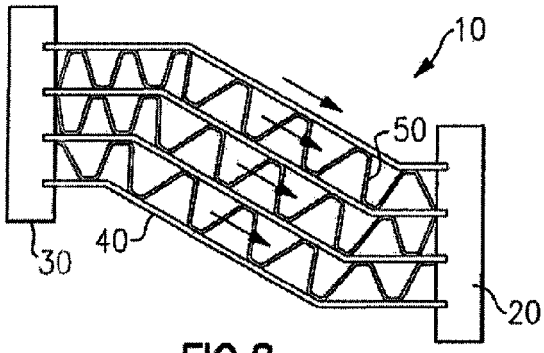
FIG. 8 is an elevation view of another exemplary embodiment of a flat tube heat exchanger having condensate drains.

Referring now to FIG. 6, to further enhance drainage of condensate form the upper external surfaces of the flattened tubular members 44 of the heat exchange tubes 40, the entire heat exchanger 10 may be tilted slightly with respect to the horizontal and vertical to provide a downhill tilt to the condensate drains extending longitudinally along the upper external surface of the flattened tubular members 44, thereby allowing for gravity to assist in the drainage of condensate along the condensate drain channels and portals. In this embodiment, the headers 20 and 30 are no longer directly vertically extending, but rather extend generally vertically, that is at a slight angle to the vertical. Similarly, the heat exchange tubes 40 do no longer extend directly horizontally, but rather extend generally horizontally, that is at slight angle to the horizontal. An angle of declination of at least 5 degrees, and generally in the range of at least 5 degrees to about 10 degrees, will be sufficient to enhance drainage of condensate along the condensate drains, whether channels or portals.

Rather than tilting the entire heat exchanger 10 at a slight angle, condensate drainage along the condensate drains associated with the heat exchange tubes 40 of the heat exchanger 10 of the invention, the heat exchange tubes 40 may be disposed at a slight angle of declination with the horizontal, while maintaining the headers 20 and 30 extending directly vertically, such as, for example, illustrated in the various embodiments of the heat exchanger 10 depicted in FIGS. 7-11. In the embodiments depicted in FIGS. 7 and 8, the inlet and outlet ends of the heat exchange tubes are offset relative to the headers 20 and 30, whereby a substantial portion (FIG. 7) or the entire length (FIG. 8) of the heat exchange tubes 40 extend longitudinally at a angle of declination to the horizontal thereby enhancing the drainage of condensate from left to right along the condensate drains. In each of these embodiments, an angle of declination of at least 5 degrees, and generally in the range of at least 5 degrees to about 10 degrees, will be sufficient to enhance drainage of condensate along the condensate drains, whether channels or portals.

Figure 9:
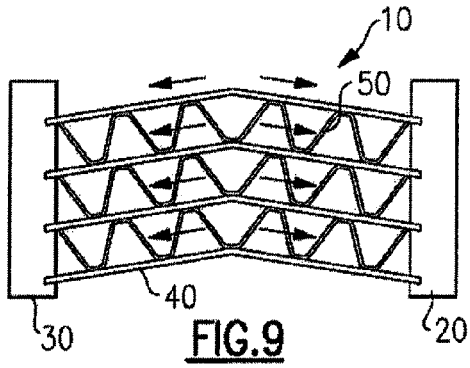
FIG. 9 is an elevation view of another exemplary embodiment of a flat tube heat exchanger having condensate drains.
Figure 10:
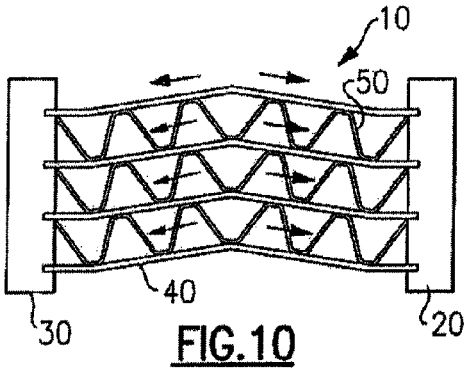
FIG. 10 is an elevation view of another exemplary embodiment of a flat tube heat exchanger having condensate drains.

In the embodiments depicted in FIGS. 9-10, each of the heat exchange tubes 40 has a generally inverted V-shape with the center of the tube at the apex of the inverted-V and the respective ends of the tube disposed at a lower elevation. Thus, the each of the left and right sections of each heat exchange tube 40 extend longitudinally from the center of the tube at a angle of declination to the horizontal thereby enhancing the drainage of condensate from the center to both the left and the right along the condensate drain. The included angle at the apex of the inverted-V should be less than 170 degrees and may generally be in the range of from about 160 degrees to less than 170 degrees, whereby the left and right sections of the heat exchange tube 40 will extend longitudinally away from the center of the tube at an angle of declination of at least 5 degrees.

Figure 11:
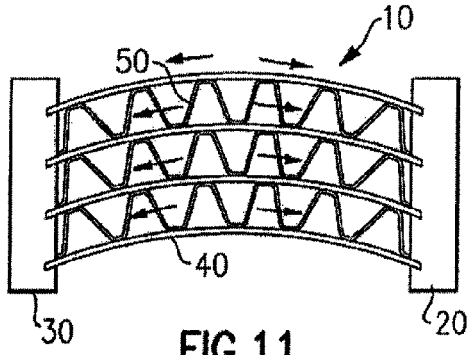
FIG. 11 is an elevation view of another exemplary embodiment of a flat tube heat exchanger having condensate drains.

In the embodiment depicted in FIG. 11, each of the heat exchange tubes 40 has an arch-like shape with the center of the tube at the apex of the arch and the respective ends of the tube disposed at a lower elevation. Thus, the each of the left and right sections of each heat exchange tube 40 again extend longitudinally from the center of the tube at a angle of declination to the horizontal thereby enhancing the drainage of condensate from the center to both the left and the right along the condensate drains. In each of these embodiments, an angle of declination of at least 5 degrees, and generally in the range of at least 5 degrees to about 10 degrees, will be sufficient to enhance drainage of condensate along the condensate drains, whether channels or portals. It has to be understood the arch may have any curvature or follow any curve suitable for manufacturing.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A heat exchanger for cooling a flow of air passing therethrough comprising:

first and second spaced apart and generally vertical longitudinally extending headers;

a plurality of heat exchange tubes disposed in parallel, spaced relationship in a generally vertical array and extending longitudinally between the first header and the second header, each of said heat exchange tubes having a longitudinal axis and a flattened cross-section, each of said flattened heat exchange tubes having an upper wall and a lower wall defining at least one longitudinally extending fluid flow passage in fluid communication between the first header and the second header, said at least one fluid flow passage having a height extending between the upper wall and the lower wall of said flattened tubular member; and at least one longitudinally extending condensate drain channel extending longitudinally along and formed in an upper external surface of the upper wall of at least one of said plurality of flattened heat exchange tubes and extending downwardly the full height of said at least one fluid flow passage.

2. The heat exchanger as recited in claim 1 wherein said at least one longitudinally extending condensate drain channel extends along a longitudinal axis positioned centrally between a leading edge and a trailing edge of at least one of said plurality of flattened heat exchange tubes.

3. The heat exchanger as recited in claim 1 wherein at least one longitudinally extending condensate drain channel extends along a longitudinal axis positioned closer to a leading edge than a trailing edge of at least one of said plurality of flattened heat exchange tubes.

4. The heat exchanger as recited in claim 1 wherein at least one longitudinally extending condensate drain channel extends along a longitudinal axis positioned closer to a trailing edge than a leading edge of at least one of said plurality of flattened heat exchange tubes.

5. The heat exchanger as recited in claim 1 wherein said at least one longitudinally extending condensate drain channel has triangular, rectangular, square, trapezoidal, circular or oval cross-section.

6. The heat exchanger as recited in claim 1 wherein said flattened tubular member has a flattened rectangular or flattened oval cross-section.

7. The heat exchanger as recited in claim 1 wherein said flattened tubular member defines a plurality of internal discrete, longitudinally extending fluid flow passages.

8. The heat exchange tube as recited in claim 7 wherein said plurality of internal discrete, longitudinally extending fluid flow passages have a circular cross-sectional flow area.

9. The heat exchanger as recited in claim 7 wherein said plurality of internal discrete, longitudinally extending fluid flow passages have a non-circular cross-sectional flow area.

10. The heat exchanger as recited in claim 1 further comprising a plurality of heat transfer fins extending between adjacent flattened heat exchange tubes of said parallel tube array.

11. The heat exchanger as recited in claim 10 further comprising at least one condensate drain portal formed in each heat transfer fin of said plurality of fins, each condensate drain portal formed in a base portion of a respective fin bounding the upper external surface of at least one heat exchange tube of said plurality of heat exchange tubes, said condensate drain portals of neighboring fins aligned generally longitudinally, thereby providing a series of longitudinally aligned condensate drain portals along the upper external surface of at least one heat exchange tube of said plurality of heat exchange tubes.

12. The heat exchanger as recited in claim 11 wherein said series of longitudinally aligned condensate drain portals extends along a longitudinal axis positioned centrally between a leading edge and a trailing edge of at least one of said plurality of flattened heat exchange tubes.

13. The heat exchanger as recited in claim 11 wherein said series of longitudinally aligned condensate drain portals extends along a longitudinal axis positioned closer to a leading edge than a trailing edge of at least one of said plurality of flattened heat exchange tubes.

14. The heat exchanger as recited in claim 11 wherein said series of longitudinally aligned condensate drain portals extends along a longitudinal axis positioned closer to a trailing edge than a leading edge of at least one of said plurality of flattened heat exchange tubes.

15. The heat exchanger as recited in claim 11 wherein said series of longitudinally aligned condensate drain portals have triangular, rectangular, square, trapezoidal, circular or oval cross-section.

16. The heat exchanger as recited in claim 11 further comprising a longitudinally extending condensate drain channel formed in the upper external surface of the upper wall of at least one of said plurality of flattened heat exchange tubes.

17. The heat exchanger as recited in claim 16 wherein said series of longitudinally aligned condensate drain portals are disposed superadjacent said longitudinally extending condensate drain channel.

18. The heat exchanger as recited in claim 11 wherein said plurality of heat transfer fins comprises a plurality of generally vertical plate-like fins extending between adjacent heat exchange tubes of said parallel tube array.

19. The heat exchanger as recited in claim 11 wherein said plurality of heat transfer fins comprises serpentine-like corrugated fins extending between adjacent heat exchange tubes of said parallel tube array.

20. The heat exchanger as recited in claim 11 wherein said a serpentine-like corrugated heat transfer fins extending between adjacent heat exchange tubes of said parallel tube array are forming one of generally triangular, rectangular or trapezoidal airflow passages.

21. The heat exchanger as recited in claim 11 wherein said plurality of heat transfer fins are at least one of louvered, wavy, offset strip or flat plate configurations.

22. The heat exchanger as recited in claim 1 wherein the longitudinal axis of said at least one flattened heat exchange tube is disposed at an angle of declination with the horizontal in the range of at least about 5 degrees.

23. The heat exchanger as recited in claim 1 wherein the longitudinal axis of each of said plurality of flattened heat exchange tube is disposed at an angle of declination with the horizontal in the range from about 5 degrees to about 10 degrees.

24. The heat exchanger as recited in claim 1 wherein said heat exchanger has a single-pass configuration.

25. The heat exchanger as recited in claim 1 wherein said heat exchanger has a multi-pass configuration.

26. The heat exchange tube as recited in claim 1 wherein said flattened tubular member extends longitudinally in the shape of an inverted-V.

27. The heat exchange tube as recited in claim 1 wherein said flattened tubular member extends longitudinally in the shape of an arch.

28. The heat exchanger tube as recited in claim 1 wherein said at least one condensate drain channel comprises a condensate drain channel extending along a longitudinal axis positioned closer to a leading edge than a trailing edge of at least one of said plurality of flattened heat exchange tubes and a condensate drain channel extending along a longitudinal axis positioned closer to a trailing edge than a leading edge of the at least one of said plurality of flattened heat exchange tubes.

* * * * *